United States Patent [19]

Yamamoto et al.

[11] Patent Number: 4,940,395

[45] Date of Patent: Jul. 10, 1990

[54] SCROLL TYPE COMPRESSOR WITH VARIABLE DISPLACEMENT MECHANISM

[75] Inventors: Tamaki Yamamoto, Honjo; Atsushi Mabe, Isesaki, both of Japan

[73] Assignee: Sanden Corporation, Gunma, Japan

[21] Appl. No.: 281,342

[22] Filed: Dec. 8, 1988

[30] Foreign Application Priority Data

Dec. 8, 1987 [JP] Japan ..... 62-185949

[51] Int. Cl.[5] ..... F04B 49/02; F04B 49/08

[52] U.S. Cl. ..... 417/310; 417/440; 418/55

[58] Field of Search ..... 417/310, 440; 418/55 R

[56] References Cited

U.S. PATENT DOCUMENTS

| | | | |
|---|---|---|---|
| 4,505,651 | 3/1985 | Terauchi et al. | 417/440 |
| 4,642,034 | 2/1987 | Terauchi | 417/295 |
| 4,673,340 | 6/1987 | Mabe et al. | 418/15 |
| 4,717,314 | 1/1988 | Sato et al. | 417/310 |
| 4,744,733 | 5/1988 | Terauchi et al. | 417/310 |
| 4,747,756 | 5/1988 | Sato et al. | 417/307 |

FOREIGN PATENT DOCUMENTS

| | | | |
|---|---|---|---|
| 0144169 | 6/1985 | European Pat. Off. | 418/55 |
| 0297840 | 1/1989 | European Pat. Off. | 417/310 |
| 3804418 | 10/1988 | Fed. Rep. of Germany | 417/310 |
| 60-101295 | 5/1985 | Japan . | |
| 0212789 | 9/1988 | Japan | 417/310 |

*Primary Examiner*—Leonard E. Smith
*Assistant Examiner*—David W. Scheuermann
*Attorney, Agent, or Firm*—Banner, Birch, McKie & Beckett

[57] ABSTRACT

A scroll type compressor with a variable displacement mechanism is disclosed and includes a housing having an inlet port and an outlet port. A fixed scroll is fixedly disposed within the housing and has a first circular end plate from which a first spiral element extends. An orbiting scroll includes a second spiral element interfitting with the spiral element. The first circular end plate partitions an inner chamber of the compressor housing into a front suction chamber linked to the inlet port, and a rear chamber. The rear chamber is further divided by a wall of said housing into a discharge chamber linked to the fluid outlet port and an intermediate pressure chamber. At least one pair of holes is formed through the circular end plate of the fixed scroll forming a fluid channel between fluid pockets formed between the spiral elements of the scrolls and the intermediate pressure chamber. A communicating channel is formed through the circular end plate of the fixed scroll providing a fluid channel which links the intermediate pressure chamber with the front chamber. A control mechanism is disposed in the housing of the compressor adjacent the intermediate pressure chamber and controls the link of the intermediate pressure chamber to the suction chamber. The control mechanism includes a piston slidably disclosed within a cylinder, and a bellows element disposed within the piston. The bellows element includes a bellows and a valve element and is responsive to the suction pressure to control the link between the suction chamber and the central fluid pocket. The piston element is responsive to the pressure in the central fluid pocket to control the link between the intermediate pressure chamber and the suction chamber to control the capacity of the compressor.

8 Claims, 6 Drawing Sheets

SCROLL TYPE COMPRESSOR WITH VARIABLE DISPLACEMENT MECHANISM

BACKGROUND OF THE INVENTION

1. Field of Invention

The invention relates to a scroll type compressor, and more particularly, to a scroll type compressor with a variable displacement mechanism.

2. Description of the Prior Art

A compressor for use in an automotive air conditioning system is driven generally by the automobile engine through an electromagnetic clutch. If the compressor is not provided with a variable displacement mechanism, when the engine rotates at a high rate the compressor will be driven at a high rate as well and the operating capacity of the compressor may be larger than necessary. Therefore, in order to ensure proper functioning of the compressor, the electromagnetic clutch must be turned on and off frequently. This frequent control of the electromagnetic clutch causes a large change in the load on the engine, reducing the speed and acceleration performance of the automobile.

Scroll-type compressors with variable displacement mechanisms for varying the compression ratio are well-known in the art. A scroll type compressor with a variable displacement mechanism is disclosed in U.S. Pat. No. 4,744,733 to Terauchi et al., incorporated by reference. With reference to FIG. 1, a scroll-type compressor with a variable displacement mechanism according to one embodiment of the '733 patent is disclosed. The scroll type compressor includes compressor housing 10 having front end plate 11 and cup-shaped casing 12 which is attached to an end surface of front end plate 11. Opening 111 is formed in the center of front end plate 11 and drive shaft 13 is disposed in opening 111. Annular projection 112 is formed on a rear surface of front end plate 11. Annular projection 112 is disposed within opening 121 of cup-shaped casing 12 and is concentric with opening 111. An outer peripheral surface of projection 112 extends along an inner wall of the opening of cup-shaped casing 12. Opening 121 of cup-shaped casing 12 is covered by front end plate 11. O-ring 14 is placed between the outer peripheral surface of annular projection 112 and the inner wall of opening 121 of cup shaped casing 12 to seal the mating surfaces of front end plate 11 and cup-shaped casing 12.

Annular sleeve 16 projects from the front end surface of front end plate 11 surrounding drive shaft 13, and defining a shaft seal cavity. Sleeve 16 is formed separately from front end plate 11. Sleeve 16 is fixed to the front end surface of front end plate 11 by screws (not shown). Alternatively, sleeve 16 may be formed integrally with front end plate 11.

Drive shaft 13 is rotatably supported by sleeve 16 through bearing 17 located within the front end of sleeve 16. Disk-shaped rotor 131 is located at the inner end of drive shaft 13 and is rotatably supported by front end plate 11 through bearing 15 located within opening 111 of front end plate 11. Shaft seal assembly 18 is coupled to drive shaft 13 within the shaft seal cavity of sleeve 16.

In operation, drive shaft 13 is driven by an external power source, for example, the engine of an automobile, through a rotation transmitting device such as magnetic clutch 20 including pulley 201, magnetic coil 202, and armature plate 203. Pulley 201 is rotatably supported by ball bearing 19 carried on the outer surface of sleeve 16.

Electromagnetic coil 202 is fixed about the outer surface of sleeve 16 by a support plate. Armature plate 203 is elastically supported on the outer end of drive shaft 13.

Fixed scroll 21, orbiting scroll 22, a driving mechanism for orbiting scroll 22, and rotation preventing thrust bearing mechanism 24 for orbiting scroll 22 are disposed in the interior of housing 10. Fixed scroll 21 includes circular end plate 211 and spiral element 212 extending from one end surface of circular end plate 211. Fixed scroll 21 is fixed within the inner chamber of cup-shaped casing 12 by screws 25 screwed into end plate 211 from the outside of cup-shaped casing 12. Circular end plate 211 of fixed scroll 21 partitions the inner chamber of cup-shaped casing 12 into two chambers, front chamber 27 including suction chamber 271 and rear chamber 28. Spiral element 212 is located within front chamber 27.

Partition wall 122 axially projects from the inner end surface of cup-shaped casing 112. The axial end surface of partition wall 122 contacts the axial end surface of circular end plate 211. Partition wall 122 divides rear chamber 28 into discharge chamber 281 formed at the center portion of rear chamber 28, and peripherally located intermediate pressure chamber 282. Gasket 26 may be disposed between the peripheral end surface of partition wall 122 and circular end plate 211 to secure the surfaces. Additional interior walls of casing 12 form communication chamber 283 and cylinder 362. Chamber 283 is linked to cylinder 361 through communicating hole **361*a*, and cylinder 361 is liked to intermediate chamber 282 through communicating hole 361*b*. Control mechanism 36 is disposed in cylinder 361**.

Orbiting scroll 22 is located in front chamber 27 and includes circular end plate 221 and spiral element 222 extending from one end surface of circular end plate 221. Spiral element 222 of orbiting scroll 22 and spiral element 212 of fixed scroll 21 interfit at an angular offset of 180° and a predetermined radial offset, forming sealed spaces between spiral elements 212 and 222. Orbiting scroll 22 is rotatably supported by bushing 23 through radial needle bearing 231. Bushing 23 is eccentrically connected to the inner end of disk-shaped rotor 131.

When orbiting scroll 22 orbits, rotation is prevented by rotation preventing/thrust bearing mechanism 24 located between the inner end surface of front end plate 11 and circular end plate 221 of orbiting scroll 22. Rotation preventing/thrust bearing mechanism 24 includes fixed ring 241, fixed race 242, orbiting ring 243, orbiting race 244, and balls 245. Fixed ring 241 is attached to the inner end surface of front end plate 11 through fixed race 242 and has a plurality of circular holes **241*a*. Orbiting ring 243 is attached to the outer surface of circular end plate 221 of orbiting scroll 22 through orbiting race 244 and has a plurality of circular holes 243*a*. Each ball 245 is placed between one hole 241*a* of fixed ring 241 and one hole 243*a* of orbiting ring 243, and moves along the edges of the holes, allowing orbital motion of orbiting scroll 22 but preventing rotation. Also, the axial thrust load from orbiting scroll 22 is supported on front end plate 11 through balls 245**.

Compressor housing 10 is provided with inlet port 31 and outlet port 32 for connecting the compressor to an external refrigeration circuit. Refrigeration fluid from the external circuit is introduced into suction chamber 271 through inlet port 31 and flows into the sealed spaces formed between spiral elements 212 and 222 when the spaces between the spiral elements sequentially open and close during the orbital motion of orbiting scroll 22. When the spaces are open, fluid to be compressed flows into these spaces but no compression occurs. When the spaces are closed, no additional fluid flows into the spaces and compression begins. Since the location of the outer terminal ends of spiral elements 212 and 222 is at final involute angle, the location of the spaces is directly related to the final involute angle. Refrigeration fluid in the sealed spaces is moved radially inwardly and is compressed by the orbital motion of orbiting scroll 22. Compressed refrigeration fluid at center sealed space 272 is discharged to discharge chamber 281 through discharge port 213, which is formed at the center of circular end plate 211. Discharge port 213 is covered by conventional flap valve 33 which allows communication in only one direction from sealed space 272 to discharge chamber 281.

Referring to FIGS. 1 and 2, a pair of holes 214, 215 are formed in end plate 211 of fixed scroll 21 and are symmetrically placed so that in operation an axial end surface of spiral element 222 of orbiting scroll 22 simultaneously crosses over both holes 214, 215. Holes 214 and 215 link the sealed spaces with intermediate pressure chamber 282. Hole 214 is placed at a position defined by involute angle $\phi$ (not shown) and opens along the inner side wall of spiral element 212. Hole 215 is placed at a position defined by involute angle ($\phi\pi$) (not shown) and opens along the outer side wall of spiral element 212. A valve member having valve plates 341, 342 is attached by fasteners 351, 352 to the end surface of end plate 211, covering holes 214, 215, respectively. Each valve plate 341, 342 is made of a spring type material so that the bias of each valve plate 341, 342 pushes it against the opening of holes 214, 215 to close each hole.

Communicating channel 29 is formed through an outer side portion of end plate 211 of fixed scroll 21 near the terminal end of spiral element 212. Communicating channel 29 links suction chamber 271 of front chamber 27 with intermediate pressure chamber 282 through communication chamber 283 and cylinder 361. Control mechanism 36 controls fluid communication between communication chamber 283 and intermediate pressure chamber 282 through communication holes **361*a* and 361*b* in cylinder 361. Control mechanism 36 includes I-shaped piston 362 slidably disposed within cylinder 361, coil spring 363 disposed between the lower end portion of piston 362 and the bottom portion of cylinder 361 to support piston 362, and magnetic valve 364. Lower projection 367 extends from piston 362 and fits within hole 361*b* when piston 362 is in its lower position. First opening 361*a* is formed on a side surface of cylinder 361 and links cylinder 361 with communication chamber 283. Second opening 361*b* is formed on the bottom portion of cylinder 361 and links cylinder 361 with intermediate pressure chamber 282. The upper portion of cylinder 361 is covered by plate 365 which includes aperture 366 at its center. Cylinder 361 is linked with discharge chamber 281 through capillary tube 368 and aperture 366. Fluid communication between cylinder 361 and discharge chamber 281 is controlled by magnetic valve 364 disposed on housing 10. Piston ring 362*c* is located around an upper peripheral surface portion of piston 362 to prevent leakage of high pressure fluid between the space of cylinder 361 exterior to piston 362 and the space within piston 362**.

When orbiting scroll 22 orbits due to rotation of drive shaft 13, refrigeration fluid flows into suction chamber 271 through inlet port 31 and then flows into sealed spaces (fluid pockets) defined between spiral elements 212 and 222. As the refrigeration fluid in the sealed spaces moves toward the center of spiral elements 212 and 222 the volume is reduced and it is compressed. The fluid is then discharged through discharge port 213 to discharge chamber 281.

When electromagnetic valve 364 is not energized, there is no communication between discharge chamber 281 and cylinder 361. Piston 362 is urged upwardly by the recoil strength of spring 363, and bottom portion **362*b* of piston 362 is located upwardly of first opening 361*a*. Intermediate pressure chamber 282 is linked to communication chamber 283 through cylinder 361 and openings 361*a* and 361*b*. Therefore, intermediate pressure chamber 282 maintains the suction pressure and some refrigeration fluid in the fluid pockets flows back into suction chamber 271 through intermediate pressure chamber 282 and communication chamber 283 via holes 214 and 215. Therefore, since the compression phase of the compressor is delayed until after the spiral element passes over and seals holes 214 and 215 isolating suction chamber 271** from the fluid pockets, the compression ratio of the compressor is reduced.

When electromagnetic valve 364 is energized, compressed fluid in discharge chamber 281 flows into cylinder 361 through conduct 368. Since the recoil strength of spring 363 is selected to be less than the force provided by the compressed fluid, piston 362 is pushed downwardly by the compressed fluid. Second hole **361*b* which links cylinder 361 with intermediate pressure chamber 282 is closed by piston 362, preventing communication between communication chamber 283 and intermediate pressure chamber 282. Therefore, the pressure in intermediate pressure chamber 282 gradually increases due to fluid passage from the fluid pockets through holes 214 and 215. The passage of compressed fluid continues until the pressure in intermediate pressure chamber 282 is equal to the pressure in the fluid pockets. When pressure equalization occurs, holes 214 and 215 are closed by the spring tension of valve plates 341 and 342. Compression then occurs normally and the displacement volume of the sealed fluid pockets is the same as the displacement volume when the terminal end of each spiral element 212, 222 first contacts circular end plates 211, 221**.

Referring to FIG. 3, a second embodiment of the control mechanism of the prior art compressor of FIG. 1 is shown. Control mechanism 40 includes piston 402 slidably disposed in cylinder 401, bellows element 403, and spring 404. Piston 402 includes openings **402*a* and 402*b* and is pushed upwardly by spring 404 disposed between the bottom portion of cylinder 401 and a lower end surface 407 of piston 402. Surface 407 closes opening 361*b* when piston 402 is lowered against spring 404. Bellows element 403 includes valve element 403*a*, and bellows 403*b* disposed with piston 402. Valve element 403*a* extends exterior of the top of piston 402 through opening 402*a* formed in the upper portion of piston 402. The interior of piston 402 is linked to cylinder 401 through hole 402*b*. Cylinder 401 is linked to discharge chamber 281 through upper chamber 405, conduit 368 and capillary tube 406**.

Since the interior of piston 402 is linked to communication chamber 283 through opening **402*b*, cylinder 401, and opening 361*a*, if the pressure in communication chamber 283 is less than the pressure of the fluid enclosed in bellows 403***b*, bellow 403*b* expands. Valve element 403*a* opens opening 402*a* of piston 402, and a small amount of compressed fluid which is supplied to the top space of cylinder 401 from discharge chamber 281 flows into communication chamber 283 through piston 402 and cylinder 401. In this situation piston 402 is pushed upwardly by the recoil strength of spring 404, and communication chamber 283 is linked to intermediate pressure chamber 282 linking suction chamber 271 to the fluid pockets. Therefore, the compression ratio is decreased.

If the pressure of the fluid in communication chamber 283 is greater than the pressure of the fluid in bellows 403*b*, bellows 403*b* contracts and opening 402*a* is closed by valve element 403*a*. In this situation, a small amount of compressed fluid flows from discharge chamber 281 into the top space of cylinder 401, and piston 402 is pushed downwardly against the recoil strength of spring 404. Opening 361*b* is closed by piston 402, suction chamber 271 is isolated from intermediate pressure chamber 282 and the compression ratio is increased.

Referring to FIGS. 4 and 5, a third embodiment of the control mechanism of the prior art compressor is shown. Magnetic clutch 20 and its associated elements are not shown in FIG. 4. Elements of FIG. 5 which are similar to those of FIG. 3 have been given like reference numerals. Needle-ball type valve 41 is connected to bellows 403*b* via connecting rod 403*c* and is biased downwardly by coil 403*d*. The upward force provided by bellow 403*b* against coil 403*d* may be controlled by adjusting its position within piston 402 by adjusting screw portion 42 of bellows element 403 received in the bottom portion of piston 402. When the pressure in cylinder 401 is less than the pressure within bellows 403*b*, bellows 403*b* expands, needle-ball type valve 41 is pushed upwardly, and opening 402*a* of piston 402 is opened. Therefore, discharge chamber 281 is placed in fluid communication with the interior of piston 402, no pressure builds in the space of cylinder 401 above piston 402 and piston 402 does not move downwardly, and intermediate pressure chamber 282 is linked to communication chamber 283. The compression ratio is decreased.

When the pressure in cylinder 401 is greater than the pressure within bellows 403*b*, bellows 403*b* contracts and needle-ball type valve 41 moves downwardly and obstructs opening 402*a* of piston 402. Discharge chamber 281 is not in fluid communication with the interior of piston 402, and the compressed fluid from discharge chamber 281 acts on the upper end surface of piston valve 402 pushing it downwardly against the recoil strength of spring 404 and sealing hole 361*b*. The link between communication chamber 283 and intermediate pressure chamber 282 is terminated and the compression ratio is increased.

In the embodiment of FIGS. 4 and 5, whenever bellows 403*b* contracts due to suction pressure and seals hole 402*a*, piston 402 will be moved downwardly due to the pressure of the fluid from discharge chamber 281 which builds up above piston 402. However, whenever bellows 403*b* expands due to lower suction pressure, fluid from the top of cylinder 401 flows through piston 402 to suction chamber 271. Piston 402 moves upwardly, allowing suction chamber 271 and intermediate pressure chamber 282 to be linked. Piston 402 will move upwardly even if at first the discharge pressure is higher than the suction pressure.

The embodiment of FIGS. 4 and 5 has the disadvantage that if compressor operation is restarted too quickly after it has been terminated, possible damage to the driving mechanism of the automobile may result. If the compressor functioning terminates during high capacity operation, piston 402 will be in its lower position due to the discharge pressure, isolating chamber 282 from chamber 283. Bellows 403*b* will remain contracted, sealing hole 402*a* until the suction pressure is dissipated sufficiently to allow hole 402*a* to be opened to equalize the suction and discharge pressures. Additionally, the pressure at the top of cylinder 401 linked to discharge chamber 281 will also dissipate slowly after the compressor stops operation. Thus, there will be a time delay after the stop of compressor operation before piston 402 moves upwardly and the compressor is returned to minimal capacity. If the compressor begins operating again at maximum capacity before piston 402 moves upwardly, the compressor will start operation at the maximum compression volume, damaging the driving mechanism of the automobile. Additionally, durability of the compressor will be reduced.

SUMMARY OF THE INVENTION

It is an object of the present invention to provide a scroll-type compressor with a variable displacement mechanism which prevents damage to the driving mechanism of an automobile when the compressor is restarted.

It is another object of the present invention to provide a scroll-type compressor with a variable displacement mechanism in which the operation of the compressor may be quickly restarted at the lowest volume.

It is still another object of the present invention to provide a scroll-type compressor with a variable displacement mechanism with improved durability.

A scroll-type compressor according to the present invention includes a housing having an inlet port and an outlet port. A fixed scroll is fixedly disposed within the housing and has a first circular end plate from which a first spiral element extends. An orbiting scroll having a second circular end plate from which a second spiral element extends is disposed on a drive shaft. The two spiral elements interfit at an angular and radial offset to form a plurality of line contacts and to define at least one pair of fluid pockets within the interior of the housing. A driving mechanism is operatively connected to the orbiting scroll to effect orbital motion of the orbiting scroll to change the volume of the fluid pockets during orbital motion. A rotation preventing mechanism prevents rotation of the orbiting scroll. The circular end plate of the fixed scroll divides the interior of the housing into a front chamber and a rear chamber. The front chamber includes a suction chamber communicating with the fluid inlet port. The rear chamber is divided into: a discharge chamber which communicates with both a fluid outlet port and the central fluid pocket formed by both scrolls; an intermediate pressure chamber; and a cylinder. At least one pair of holes is formed through the circular end plate of the fixed scroll to form a fluid channel between the fluid pockets and the intermediate pressure chamber. A communication channel formed through the circular end plate of the fixed scroll provides a fluid channel between the intermediate pressure chamber and the suction chamber. A control means is disposed in the cylinder in the compressor housing and controls the opening and closing of the communication channel. The central fluid pocket is linked by a further channel to the cylinder. A valve element of the control device is controlled by the compressed fluid in the central fluid pocket to control the link between the suction chamber and the central fluid pocket to further control the link between the suction and intermediate pressure chambers.

Further objects, features and other aspects of this invention will be understood from the detailed description of the preferred embodiments of this invention with reference to the drawings.

DETAILED DESCRIPTION OF THE PREFERRED EMBODIMENTS

Figure 1:
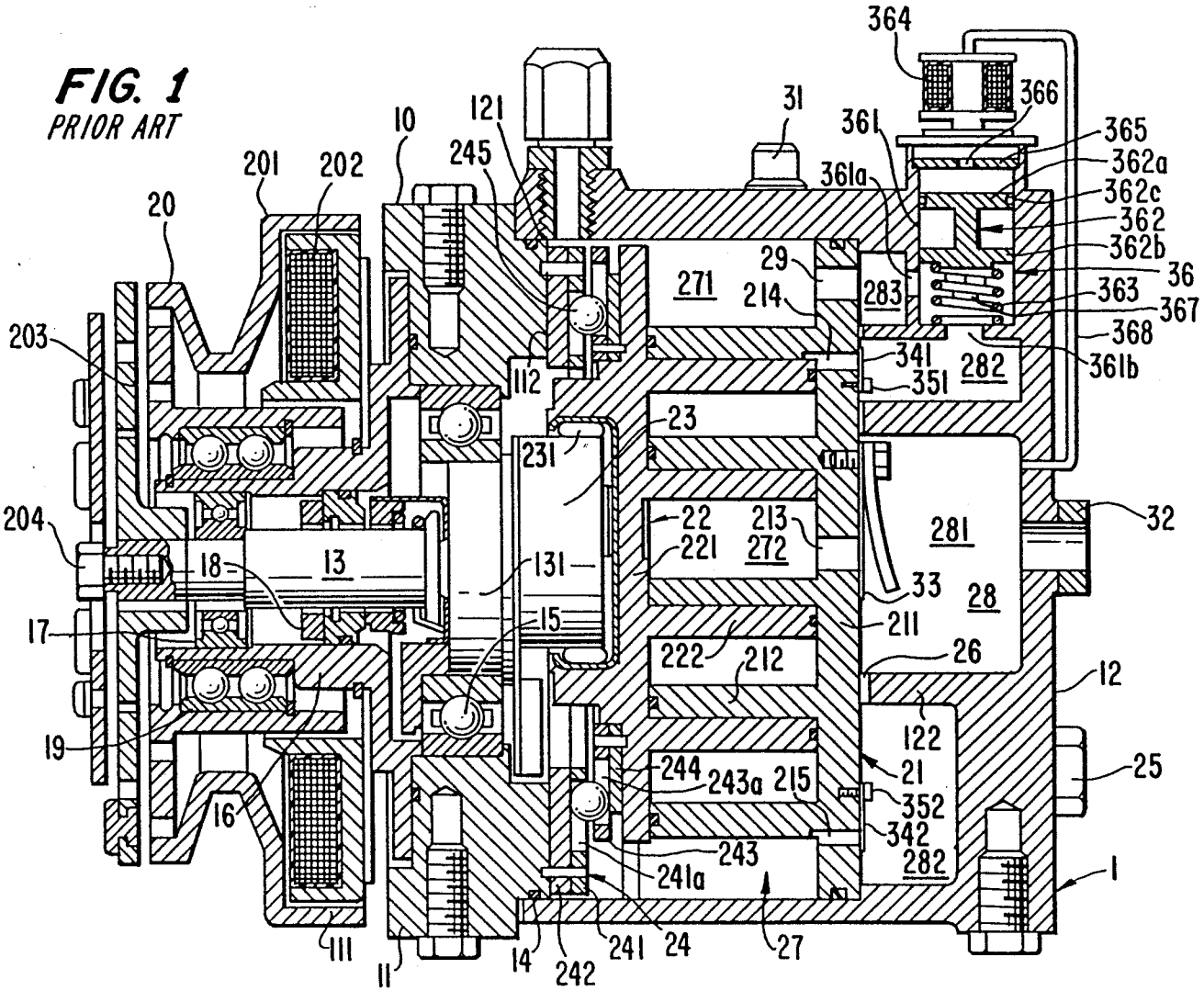
FIG. 1 PRIOR ART
FIG. 1 is a cross-sectional view of a scroll-type compressor including a variable displacement mechanism in accordance with the prior art.
Figure 2:
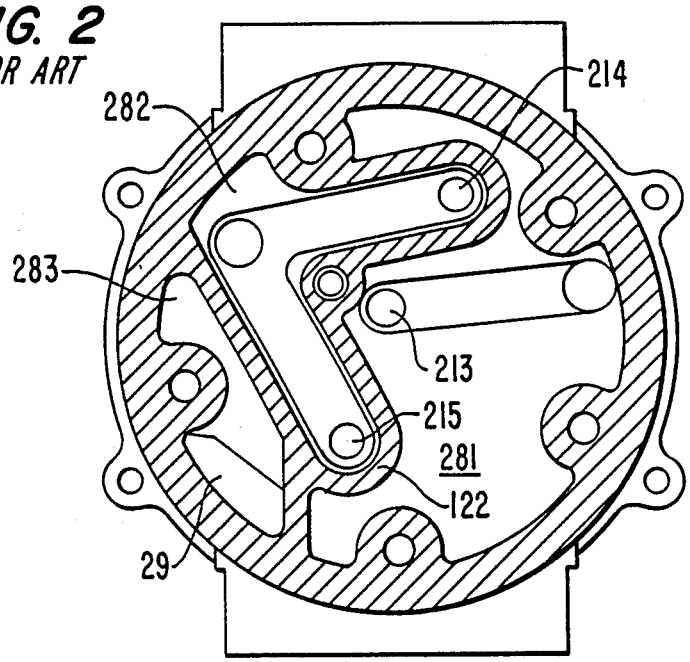
FIG. 2 PRIOR ART
FIG. 2 is a sectional view of the prior art compressor of FIG. 1 illustrating the position of the holes in the end plate.
Figure 5:
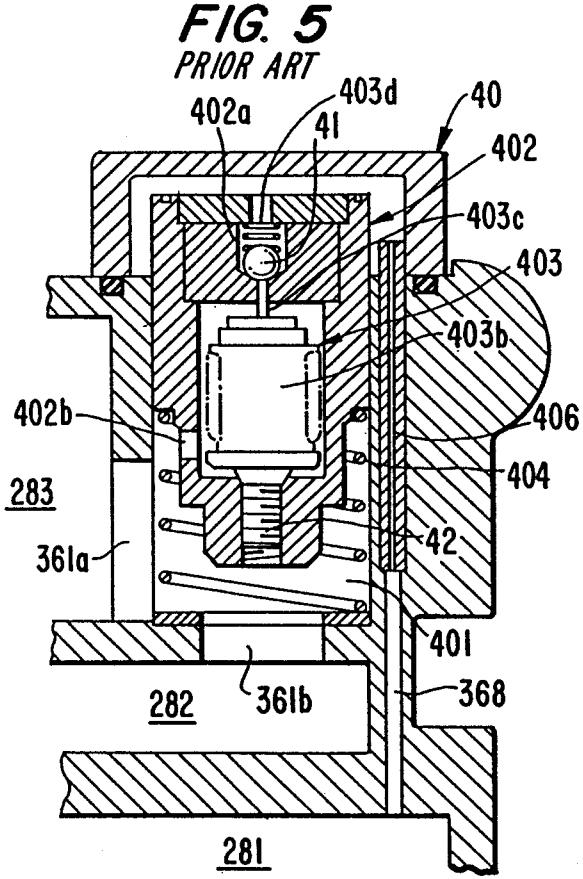
FIG. 5 PRIOR ART
FIG. 5 is a cross-sectional view of the prior art variable displacement mechanism shown in FIG. 4.
Figure 3:
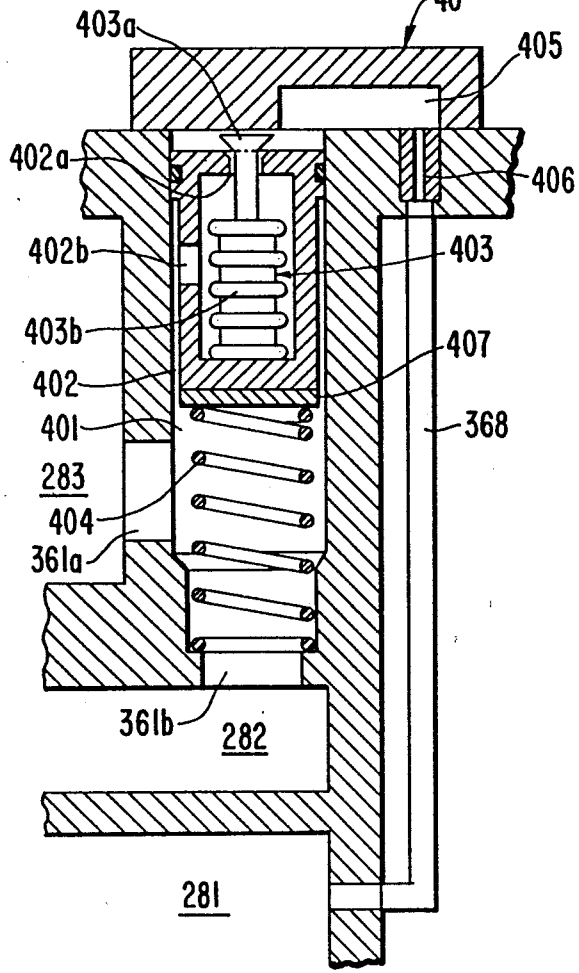
FIG. 3 PRIOR ART
FIG. 3 is a cross-sectional view of a second prior art embodiment of a variable displacement mechanism of the prior art scroll-type compressor of FIG. 1.
Figure 4:
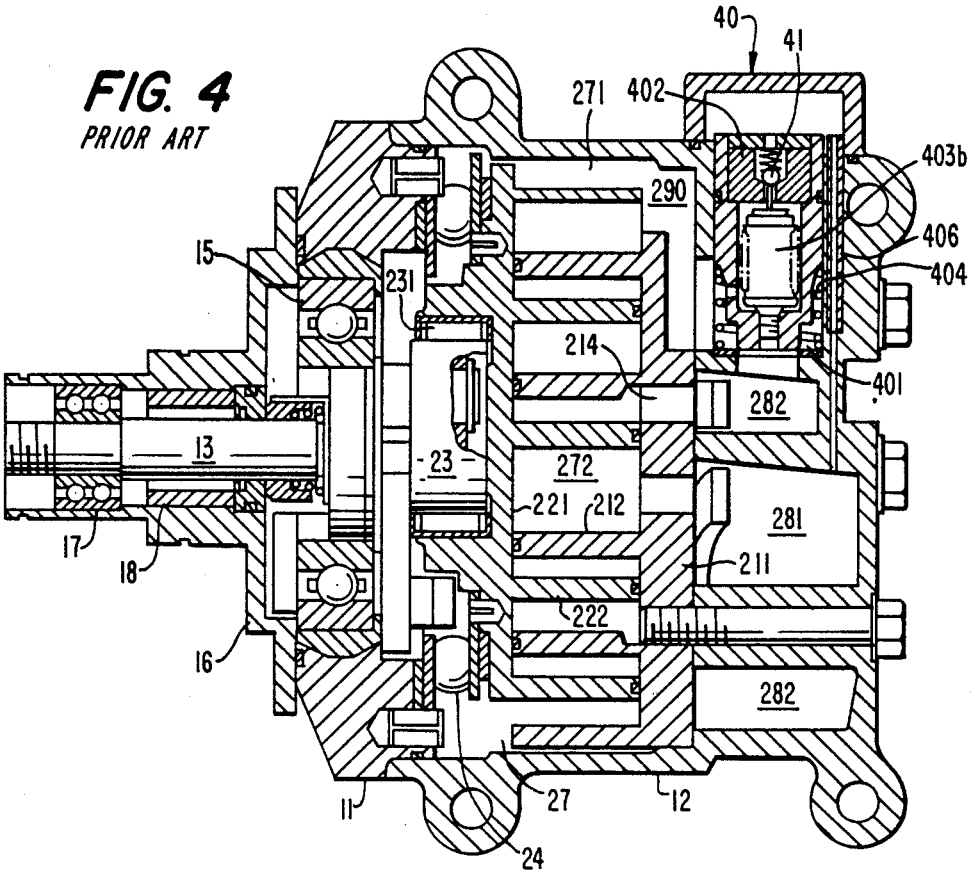
FIG. 4 PRIOR ART
FIG. 4 is a cross-sectional view of the prior art compressor of FIG. 1 including a third prior art embodiment of a variable displacement mechanism.
Figure 6:
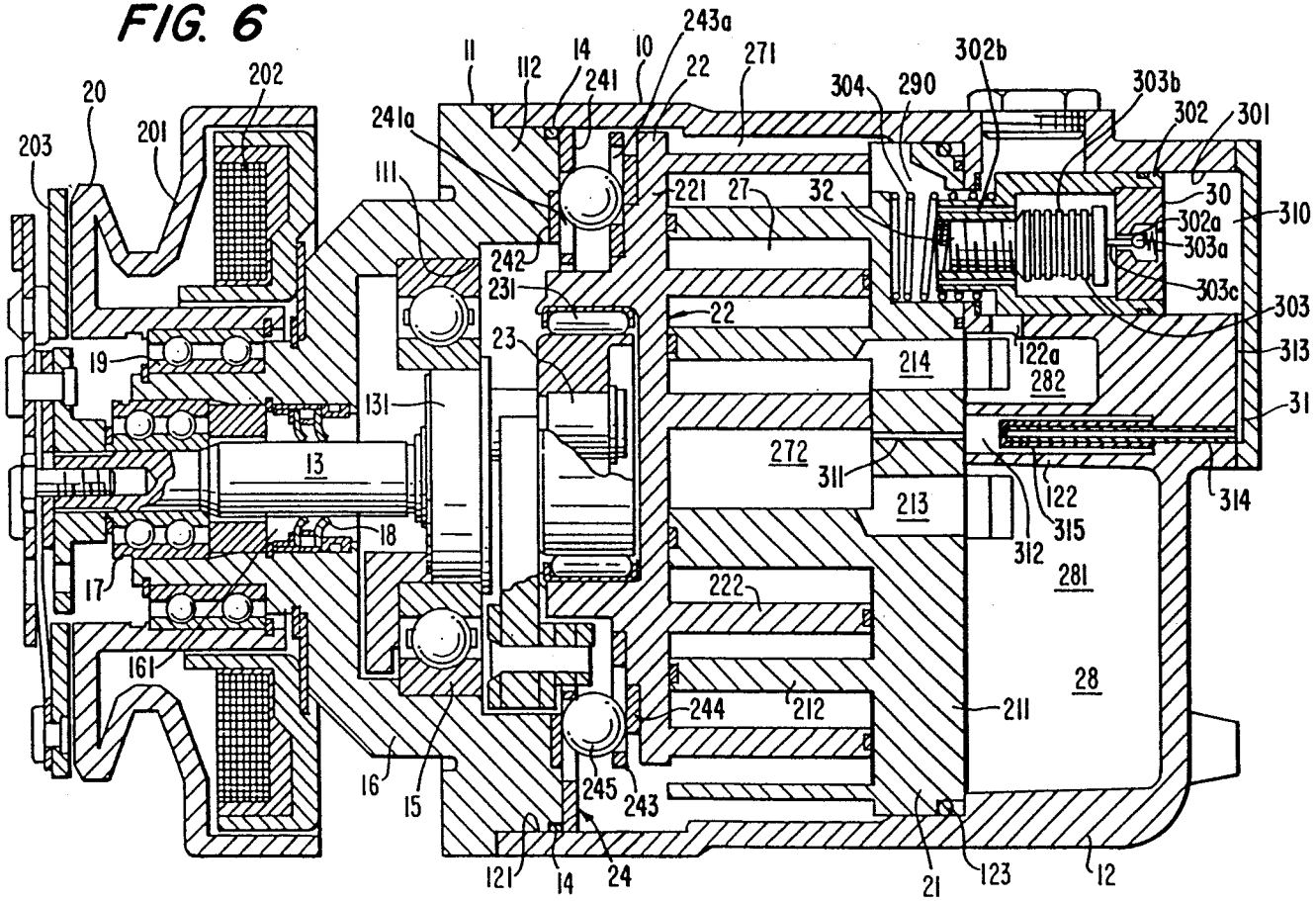
FIG. 6 is a cross-sectional view of a scroll type compressor with a variable displacement mechanism in accordance with a first embodiment of this invention.

Referring to FIG. 6, a scroll-type compressor in accordance with the first embodiment of this invention is shown. The compressor of FIG. 6 is similar to that shown in FIG. 1 and similar elements have been given the same reference numerals and for the sake of brevity, will not be described again. Partition wall 122 of casing 12 divides rear chamber 28 into three chambers: discharge chamber 281, intermediate pressure chamber 282, and cylinder 301. Discharge chamber 281 is linked to central fluid pocket 272 at the center of the spiral elements by discharge port 213 formed through circular end plate 211 of fixed scroll 21. Intermediate pressure chamber 282 is linked to an outer fluid pocket via communication hole 214 formed through end plate 211 of fixed scroll 21. A second communication hole (not shown) is also formed through the end plate. Intermediate chamber 282 is linked to cylinder 301 through opening 122*a* formed through partition wall 122. Communication channel 290 is formed in casing 12 and links suction chamber 271 to cylinder 301. Control mechanism 30 controls fluid communication between intermediate pressure chamber 282 and suction chamber 271 through channel 290, and includes piston 302 disposed in cylinder 301, bellows element 303, and spring 304 disposed within cylinder 301 at the left end of cylinder 301.

Piston 302 slidably disposed within cylinder 301, includes opening 302*a* linking the interior of piston 302 to cylinder chamber 310 formed on the right side of cylinder 301. Piston 302 also includes opening 302*b* linking the interior of piston 302 to communication channel 290. Bellows element 303 includes bellows 303*b* disposed in the interior of piston 302 and needle-ball portion 303*a* connected to bellows 303*b* through connecting rod 303*c*. Needle-ball portion 303*a* extends to the exterior of piston 302 and engages opening 302*a* to seal it when bellow 303*b* contracts. Screw portion 32 is disposed at the leftmost side of bellows element 303 and is screwed into the bottom portion of piston 302 to adjust the position of bellows 303*b* within piston 302. Spring 304 is disposed between a rear end surface of circular end plate 211 and piston 302 and biases piston 302 to its rightmost position, linking intermediate chamber 282 with suction chamber 271 through communication channel 290 and opening 122*a*.

Chamber 310 of cylinder 301 is linked to central pocket 272 via bypass channel 31. Bypass channel 31 includes first conduit 311 formed through circular end plate 211 and linking central pocket 272 to interior space 312 formed within partition wall 122. Bypass 31 further includes second conduit 313 formed in an inner end surface of cup-shaped casing 12. Second conduit 313 links interior space 312 to chamber 310 via orifice tube 314 disposed in cup-shaped casing 12 and opening into interior space 312. One end of orifice tube 314 is covered by filter 315 disposed within interior space 312.

In operation, at small loads, the pressure within piston 302 which is linked to suction chamber 271 through hole 302*b* is less than the pressure provided within bellows 303*b*. Bellows 303*b* expands, moving valve element 303*a* to the right, uncovering opening 302*a*. Central pocket 272 is linked with the interior of piston 302 through bypass channel 31, and chamber 310, and is further linked to suction chamber 271 by opening 302*b* and channel 290. Pressure does not build in chamber 310 and piston 302 is in its rightmost position. The outer fluid pockets 272 are linked to suction chamber 271 through intermediate chamber 282, hole 122*a* and communication channel 290. Therefore, the compression ratio is reduced.

When the load on the air conditioning is large, the pressure in suction chamber 271 and thus within piston 302 is greater than the pressure provided within bellows 303*b*. Bellows 303*b* contracts moving valve element 303*a* to the left, closing opening 302*a* of piston 302. The link between central pocket 272 and the interior of piston 302 is terminated and, the pressure within chamber 310 due to the compressed fluid from central pocket 272 increases, and acts on the right side surface of piston 302. Piston 302 is moved leftwardly against the recoil strength of spring 304, obstructing the link between suction chamber 271 and intermediate pressure chamber 282. The compression ratio of the compressor is maximum.

If operation of the compressor is terminated at a time when piston 302 obstructs communication between suction chamber 271 and intermediate pressure chamber 282, that is, at maximum capacity, high pressure gas located in central pocket 272 leaks into outer pockets formed between the spiral elements. Orbiting scroll 22 is moved in an orbiting direction generally opposite to the rotational direction of drive shaft 13 due to the force of the compressed gas leaking to the outer pockets. The pressure in central pocket 272 is quickly reduced, and thus, the pressure of the fluid in chamber 310 to the right of piston 302 is reduced as well. The rate of reduction of pressure in chamber 310 is greater than if chamber 310 were connected to discharge chamber 281, and piston valve 302 quickly moves to the right, restoring the link between intermediate chamber 282 and suction chamber 271. Therefore, the compressor may restart operation at the lowest compression volume. Damage to the compressor or drive mechanism is prevented.

Figure 7:
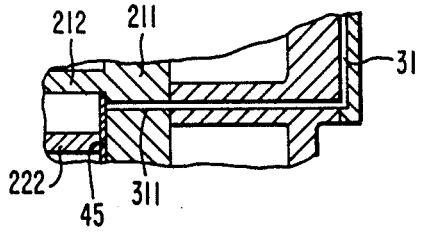
FIG. 7 is a partial cross-sectional view of a scroll type compressor with a variable displacement mechanism in accordance with a second embodiment of the present invention.

With reference to FIG. 7, a part of a scroll type compressor with a variable displacement mechanism in accordance with a second embodiment of the present invention is shown. In the second embodiment, bottom plate 45 is disposed on the inner end surface of circular end plate 211 of fixed scroll 21 and extends over the opening of bypass 31. Bottom plate 45 reduces the volume of gas flowing therethrough and into bypass 31, allowing orifice 314, filter 315, and interior space 312 to be omitted.

Figure 8:
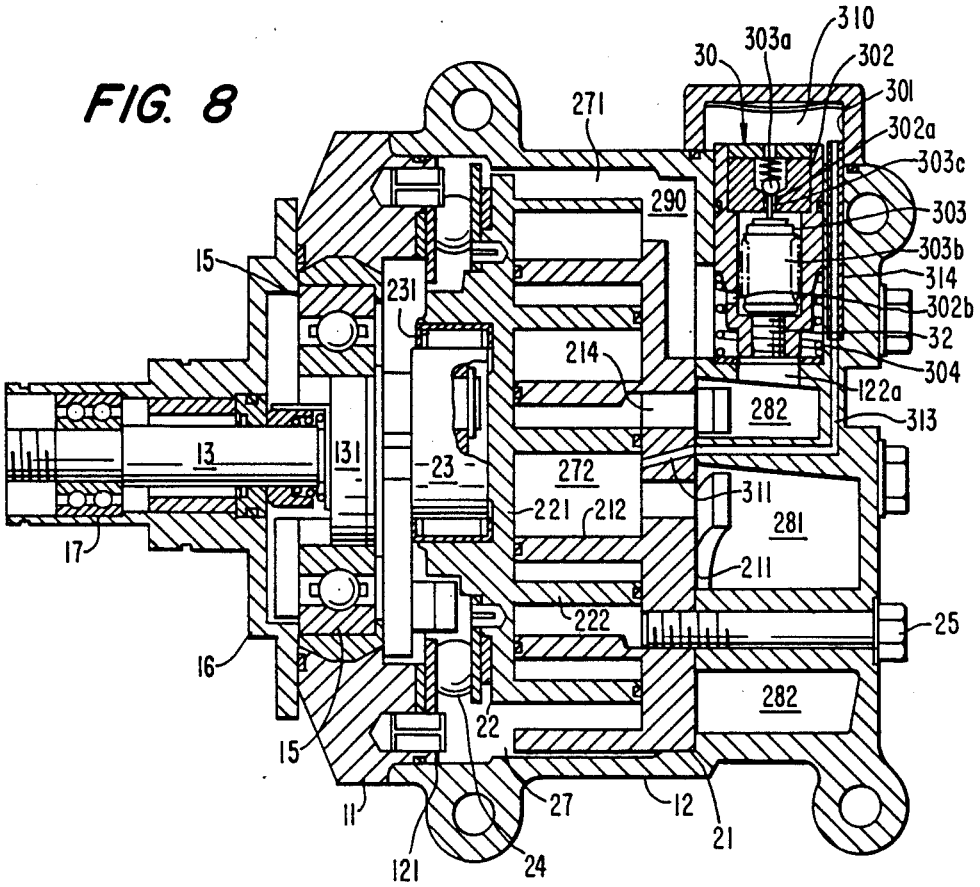
FIG. 8 is a cross-sectional view of a scroll type compressor with a variable displacement mechanism in accordance with a third embodiment of the present invention.

With reference to FIG. 8, a scroll type compressor with a variable displacement mechanism in accordance with a third embodiment of this invention is shown. FIG. 8 is similar to FIG. 1 with the exception that the control mechanism is different, and pulley mechanism 20 and its associated elements are not shown. Control mechanism 30 is identical to that shown in FIG. 6 except that piston 302 is vertically disposed in cylinder 301 and is biased upwardly by spring 304. Therefore, chamber 310 is located above piston 302 and is linked directly to central pocket 272 through conduit 311 formed in circular end plate 211, and bypass 313 including orifice tube 314. In all other respects, FIG. 8 is identical to FIG. 6 and functions in the same manner.

This invention has been described in detail in connection with preferred embodiments. These embodiments, however, are merely for example only and the invention is not restricted thereto. It will be understood by those skilled in the art that other variations and modifications can easily be made within the scope of this invention as defined by the appended claims.

We claim:

1. In a scroll type compressor including a housing having an inlet port and an outlet port, a fixed scroll disposed within said housing and having a first circular end plate from which a first spiral element extends into the interior of said housing, an orbiting scroll having a second circular end plate from which a second spiral element extends, said first and second spiral elements interfitting at an angular and radial offset forming a plurality of line contacts and defining a central fluid pocket and at least one pair of outer fluid pockets within the interior of said housing, a driving mechanism operatively connected to said orbiting scroll to effect orbital motion of said orbiting scroll, rotation preventing means for preventing the rotation of said orbiting scroll during orbital motion, said first circular end plate dividing the interior of said housing into a front chamber and a rear chamber, said front chamber communicating with said inlet port, said rear chamber further divided into a discharge chamber, an intermediate pressure chamber and a cylinder, said discharge chamber linked with said outlet port and with said central fluid pocket formed between said spiral elements, a one way valve means for providing fluid communication in one direction from said central fluid pocket to said discharge chamber, at least one pair of holes formed through said first circular end plate and forming a fluid channel between said outer fluid pockets and said intermediate pressure chamber, a communication passageway including said cylinder linking said intermediate pressure chamber with said front chamber, and control means disposed in said cylinder for controlling fluid communication between said intermediate pressure chamber and said front chamber through said cylinder, the improvement comprising:

a bypass channel linking said cylinder in fluid communication with said central fluid pocket, and said control means comprising a piston slidably disposed within said cylinder and a control valve, said piston responsive to the fluid pressure in said central fluid pocket to slide in said cylinder to control the link between said intermediate chamber and said front chamber, said control valve controlling the link between said central fluid pocket and said front chamber through said piston.

2. The compressor recited in claim 1, said control valve comprising a bellows disposed in said piston and a valve element attached thereto, said piston having a first and a second hole, said first hole linking the interior of said piston to said central fluid pocket, said second hole linking the interior of said piston to said front chamber, said bellows responsive to pressure in said front chamber to open or close said first hole.

3. The compressor recited in claim 2, said control valve further comprising a screw disposed on said bellows opposite said valve element, said screw screwed into the base of said piston, the position of said bellows within said piston being controlled by said screw.

4. The compressor recited in claim 1 further comprising an orifice tube and a filter located in an interior space in said housing, said interior space and said orifice tube linking said central fluid pocket to said cylinder.

5. The compressor recited in claim 1, said driving mechanism including a drive shaft, said cylinder having a longitudinal axis which is disposed essentially perpendicularly to the longitudinal axis of said drive shaft.

6. The compressor recited in claim 1, said driving mechanism including a drive shaft, said cylinder having a longitudinal axis which is disposed essentially parallel to the longitudinal axis of said drive shaft.

7. The compressor recited in claim 1, said housing comprising a first hole linking said cylinder to said intermediate chamber and a second hole linking said cylinder to said front chamber, said piston sliding in said cylinder to control the link of said cylinder to said intermediate chamber through said first hole.

8. The compressor recited in claim 7, said housing further comprising a communication channel linked to said cylinder by said second hole, said front chamber further comprising a suction chamber, said communication channel linking said suction chamber to said cylinder through said second hole.

* * * * *